US005102124A

United States Patent [19]

Diodati

[11] Patent Number: 5,102,124

[45] Date of Patent: Apr. 7, 1992

[54] BARBELL

[76] Inventor: Joseph M. Diodati, 344 Dacy Road, Apt. #103, Sault Ste Marie, Ontario, Canada, P6B 3M4

[21] Appl. No.: 603,060

[22] Filed: Oct. 25, 1990

[51] Int. Cl.[5] ..... A63B 21/075

[52] U.S. Cl. ..... 482/107; 482/108; 482/106

[58] Field of Search ..... 272/67, 68, 117, 118, 272/119, 122, 123, 124; 273/171; 206/315.1

[56] References Cited

U.S. PATENT DOCUMENTS

| | | | |
|---|---|---|---|
| 1,133,129 | 3/1915 | Govan | 273/171 |
| 1,316,683 | 9/1919 | Calvert | 272/122 |
| 1,779,594 | 10/1930 | Hall | 272/123 |
| 4,103,887 | 8/1978 | Shoofler | 272/123 |
| 4,482,151 | 11/1984 | Zwilling | 272/123 |
| 4,529,198 | 7/1985 | Hettick, Jr. | 272/117 X |
| 4,673,179 | 6/1987 | Pengler | 272/122 X |
| 4,756,526 | 7/1988 | Broussard | 272/123 |

*Primary Examiner*—Robert Bahr
*Attorney, Agent, or Firm*—Bereskin & Parr

[57] ABSTRACT

Exercise apparatus comprises a mounting member in the form of a bar and weights for location at the ends of the mounting member. Each weight has a substantially planar base and a mounting channel above the centre of gravity of the weight. The bar has mounting portions of complementary non-circular cross section to the mounting channels in the weights. The coupling between the channels and the weights and the mounting portions of the bar are configured to prevent rotation of the weight on the bar, such that during exercises the centre of gravity of the weights remains below the bar. A rotatable grip portion is provided on the bar, to accommodate rotation of the grip of the lifter on the bar.

37 Claims, 4 Drawing Sheets

BARBELL

FIELD OF THE INVENTION

This invention relates to improvements in exercise apparatus for use in weight training and weight lifting, and in particular to an improved barbell configuration.

The original barbells were, as suggested by the name, formed of two cast bells suspended from the ends of a bar, and the original, related dumb-bell was simply a bell from which the clapper had been removed. The current form of barbell, formed of a cylindrical steel bar on which weighted discs are mounted and secured by locking collars, has been in common use since the 1920's. The discs come in various different forms, but are most often formed of steel, less expensive discs being formed of concrete filled plastic shells. These forms of discs have numerous disadvantages: if a disc is laid flat on a floor it can be very difficult to pick up and more often than not, it would be necessary to use one's fingertips or fingernails to obtain a grip at the edge of the often heavy disc; when mounting a disc on a bar it is necessary to locate the bar through a central aperture in the disc and such an operation will often require two persons, one to position the bar and one to hold the disc upright; once a disc is on the bar and other discs are being positioned on the bar it is not unusual for persons to nip or trap fingers between discs; and a bar provided with discs at its ends will roll if positioned on a sloping surface, creating a hazard.

The tendency of barbells to roll on sloping surfaces has led to the common use of barbell stands in which the bar is supported between two aligned mountings. Replacing a weighted bar on this form of mounting can be difficult, particularly if the lifter has become tired during an exercise or has attempted an exercise with too great a weight. Also, conventional apparatus, such as the flat benches as used in bench press exercises, is often designed such that a weighted bar which an operator fails to locate on the mounting may fall onto the lifter executing the exercise.

An improved dumb-bell configuration is disclosed in applicant's existing United States patent application, Ser. No. 07/497/952, filed on Mar. 22, 1990.

SUMMARY OF THE INVENTION

Accordingly to the present invention there is provided exercise apparatus including a weight having a substantially planar base and mounting means above the center of gravity of the weight, the mounting means comprising channel means for releaseably receiving a mounting member of complementary cross section. The coupling between the channel means and the mounting member is arranged to prevent rotation between the weight and the mounting member.

The mounting member may be in the form of a bar and, in most applications, two weights will be provided at each end of the mounting member. A grip portion may be provided on the mounting member and be rotatable relative to mounting portions provided at the ends of the member. Thus, as the bar and the weights are lifted during exercises, the bar and weights may rotate relative to the grip portion, which is held by the lifter, such that the center of gravity of each weight remains below the bar. This has the effect of making the exercises more stable than would be the case with conventional disc-shaped weights.

Each weight may include a weight portion located below the mounting means. Preferably, the weight portion includes a separable weighted unit and a weight support means mounted to the mounting means and adapted for mounting the weighted unit. Most preferably, the weight support means is in the form of an outer shell including door means to allow a separable weighted unit to be located in the shell. To vary the mass of the weight, a plurality of weight units of common shape and size and of different weights may be provided. Alternatively, each weight unit may consist of a number of separable elements which may be selectively removed from the shell to vary the mass of the weighted unit.

Preferably, the outer shell of the weight portion has a substantially planar base, mutually parallel end walls in the form of truncated triangles and sidewalls extending downwardly and outwardly from the mounting portion. The door means may be formed by one of the sidewalls of the outer shell.

Providing a planar base permits the weights to be stably located on any suitably supported flat surface and allows weights to be set down with considerably less precision than is required for resting barbells on conventional stands.

The channel means may be in the form of a throughbore extending through an upper portion of the weight, or alternatively, may take the form of a channel formed in an upper surface of the weights and including mounting member retaining means moveable between a locking position for locking the mounting member in the channel and a retracted position. Where the channel means takes the form of a throughbore, a weight is mounted on a bar by passing the end of the bar through the throughbore. In the alternative configuration, the bar is dropped into the channel and the mounting member retaining means then located to lock the mounting member in the channel. This permits an operator to simply leave the weight standing on a surface and manipulate the bar to engage the channel.

BRIEF DESCRIPTION OF DRAWINGS

These and other aspects of the present invention will now be described, by way of example, with reference to the accompanying drawings, in which.

DETAILED DESCRIPTION OF DRAWINGS

Figure 1:
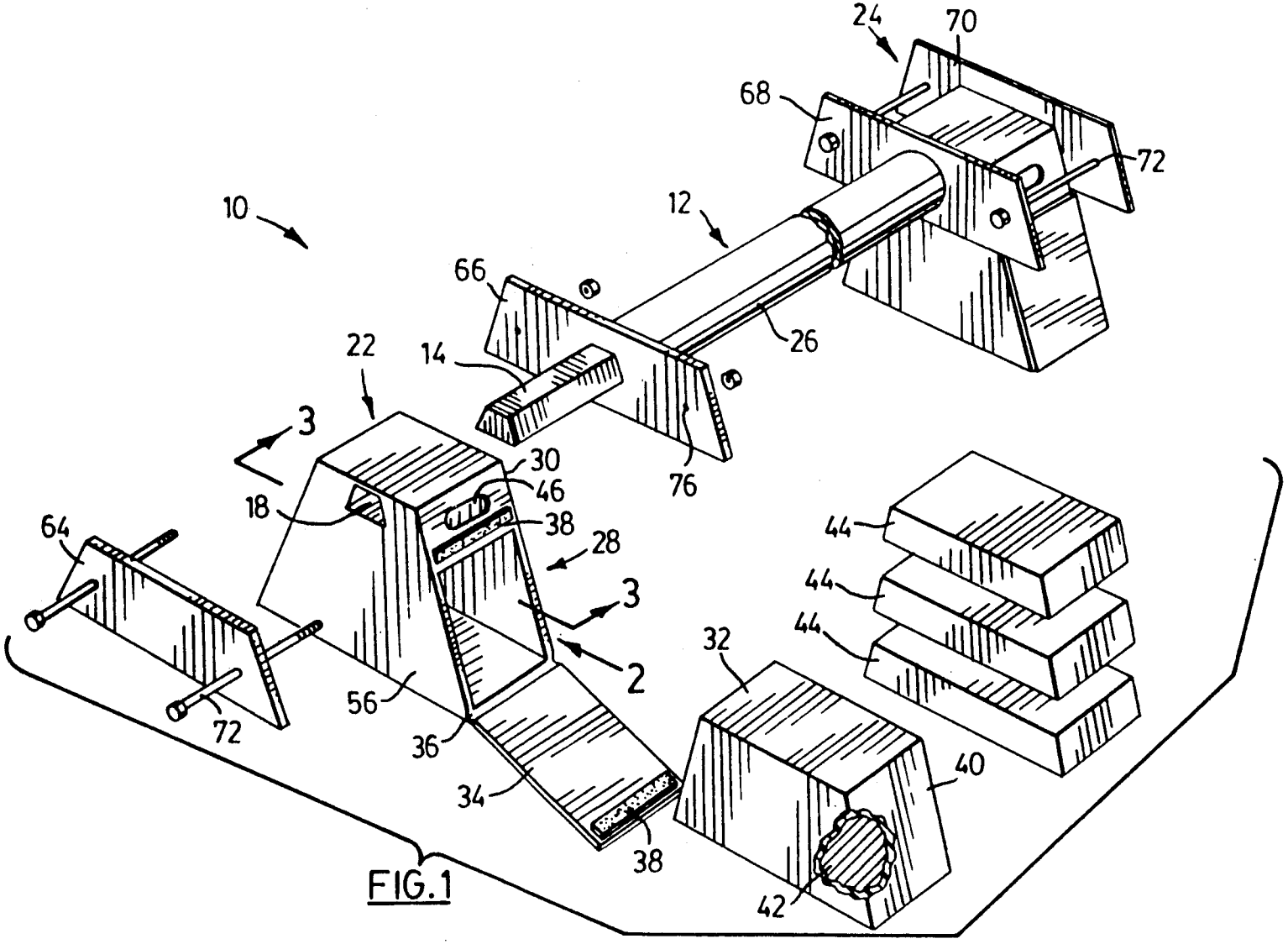
FIG. 1 is a perspective, partially exploded view of exercise apparatus in accordance with a preferred embodiment of the present invention.

Reference is first made to FIG. 1 of the drawings, which illustrates exercise apparatus, generally indicated by the reference numeral 10, intended for use in a similar fashion to barbells and the like. The apparatus 10 includes a mounting member 12 having mounting portions 14 (only one visible) at its ends for engaging mounting means, in the form of channels 18 (only one visible), of two weights 22, 24.

The channels 18 are located at the upper ends of the weights 22, 24 such that the center of gravity of each weight is positioned below the channels 18 and thus the weights 22, 24 will tend to maintain the orientation as shown in FIG. 1. As will be described, the mounting portions 14 and channels 18 are of complementary, non-circular cross section such that the weights 22, 24 tend to maintain the orientation of the mounting member 12 during exercises. To accommodate rotation of the weights and mounting member which may occur during a lifting exercise, a grip portion 26 is provided which is rotatable relative to the other structure of the mounting member 12.

Figure 2:
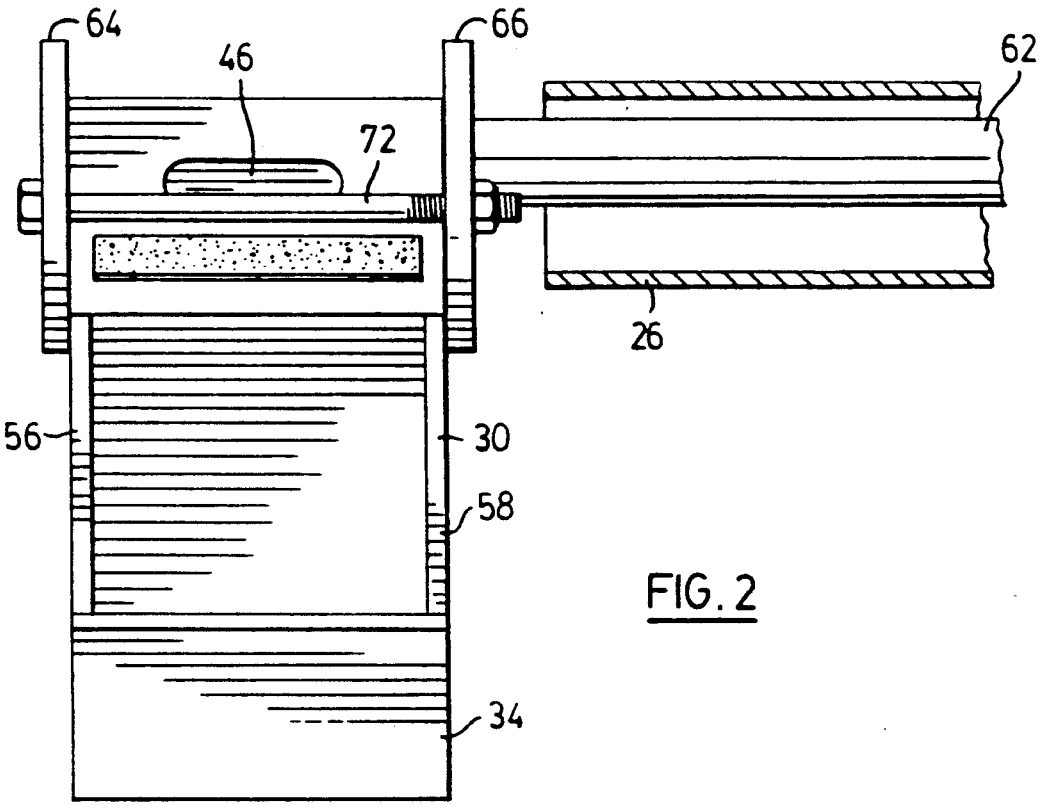
FIG. 2 is a view, corresponding to a view taken along line 2 of FIG. 1, of a portion of an assembled exercise apparatus.
Figure 3:
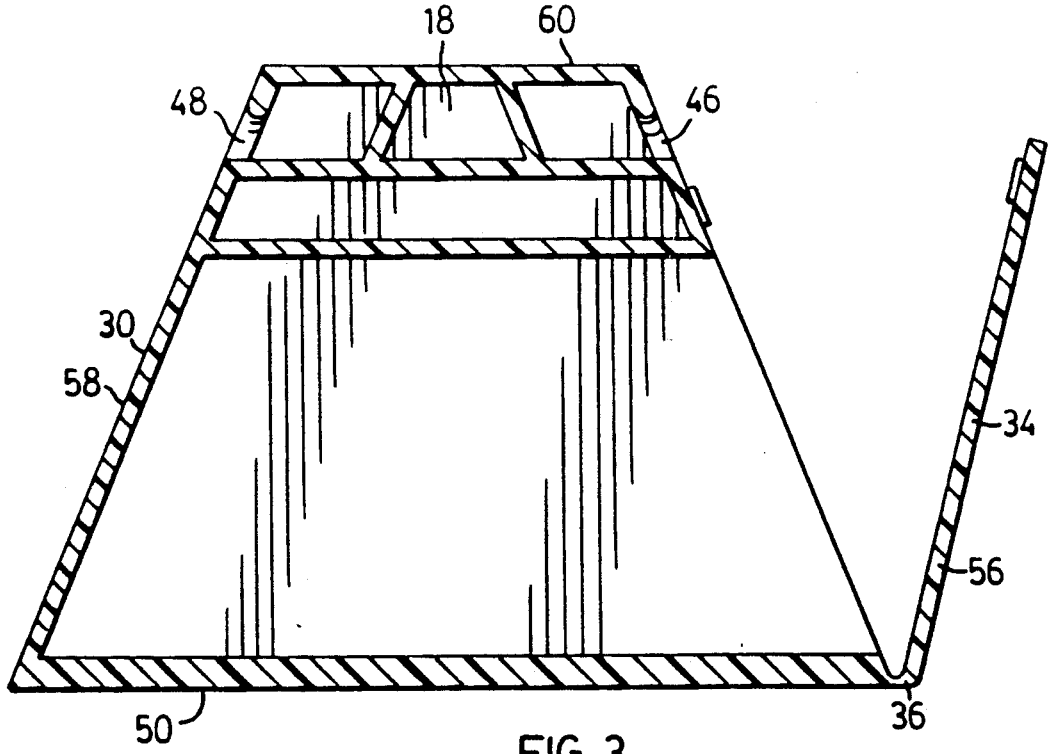
FIG. 3 is a sectional view on line 3—3 of FIG. 1.

As both weights 22, 24 are substantially similar, the weight 22 will be described as exemplary of both, with reference also to the FIGS. 2 and 3 of the drawings. As mentioned above, the mounting means for the weight 22, in the form of the channel 18, is provided towards the top of the weight above a weight containing portion 28 including weight support means in the form of a shell 30, and a separable weighted unit 32. The interior of the shell 30 and the exterior of the weighted unit 32 are of complementary shape and the unit 32 may be removed from the shell 30 through door means in the form of an openable flap 34 formed in a sidewall of the shell 30. In this particular example, the shell 30 is formed of plastic material and the flap 34 is joined to the shell 30 by means of a living hinge 36. The flap 34 is held closed by hook and loop fastening tape 38, such as that sold under the VELCRO Trademark.

The weighted unit 32 may be formed of a unitary casting or moulding of a single material, but is preferably formed with a plastic exterior shell 40 and contains a weight material 42. The choice of weight material 42 will vary depending on the desired mass and volume of the unit, and may include sand or cement, though is preferably in the form of a metal-based material. As the material 42 is encapsulated within the shell 40, it is not necessary that the material has structural strength or has an attractive appearance. Accordingly, relatively inexpensive metal ores may be used to fill the shell 40.

To vary the mass of the weight 20, it is possible to provide weighted units 32 of different mass which may be exchanged to provide various levels of resistance for different exercises. Alternatively, rather than providing a single weighted unit 32, a plurality of "cassettes" 44 may be provided. The cassettes 44 are formed in a similar manner to the unit 32 and together have similar dimensions to the unit 32, and the interior of the shell 30. To vary the mass of the weight 22 when using the cassettes 44, single cassettes may be added to or removed from the shell 30.

To facilitate carrying of the weight 22, carrying handles 46, 48 in the form of indents are provided on upper portions of opposite sides of the weight.

In this example, the weight 22 has a substantially planar base 50, mutually parallel endwalls 52, 54 defining truncated triangles and sidewalls 56, 58 extending downwardly and outwardly from a planar top surface 60. For the majority of exercises it will be sufficient that the various walls of the shell 30 are formed of plastic and may be relatively thin, as may be seen from FIG. 3. For exercises in which very heavy weights are to be lifted, thicker or reinforced plastic materials may be used, or alternatively the shell 30 may be formed of steel or a suitable alloy.

The weight 22 is mounted on a mounting portion 14 of the mounting member 12 which forms the ends of the mounting member. The channel 18 in the weight 22 is of complementary shape to the mounting portion, in this example both being truncated triangular in cross section. The mounting portions 14 form the ends of a bar 62 and the grip portion 26 is in the form of a cylindrical sleeve which is fitted over the bar. The bar and sleeve may be formed of plastic, reinforced plastic or steel, plastic being preferred for lighter applications.

The weights 22, 24 are held in place by retaining means in the form of plates 64, 66, 68, 70. Two of the plates 66, 68 are fixed to the bar 62 to locate the grip portion 26 and to define stops for the weights 22, 24 and abut inner end walls of the weights. The other plates 64, 70 are used to secure the weights 22, 24 on the mounting portions 14 and abut the outer end walls of the weights. The plates 64, 70 extend beyond the sides of the weights and are held in place by pins or bolts 72 which may pass through the outer plates and are secured to a respective inner plate. In the example shown the bolts 72 have threaded ends for engaging nuts positioned on the opposite side of the plates 66, 68. However, the nuts 74 could equally well be fixed to the plates 66, 68 or the apertures 76 in the plates could be provided with internal threads.

Figure 4:
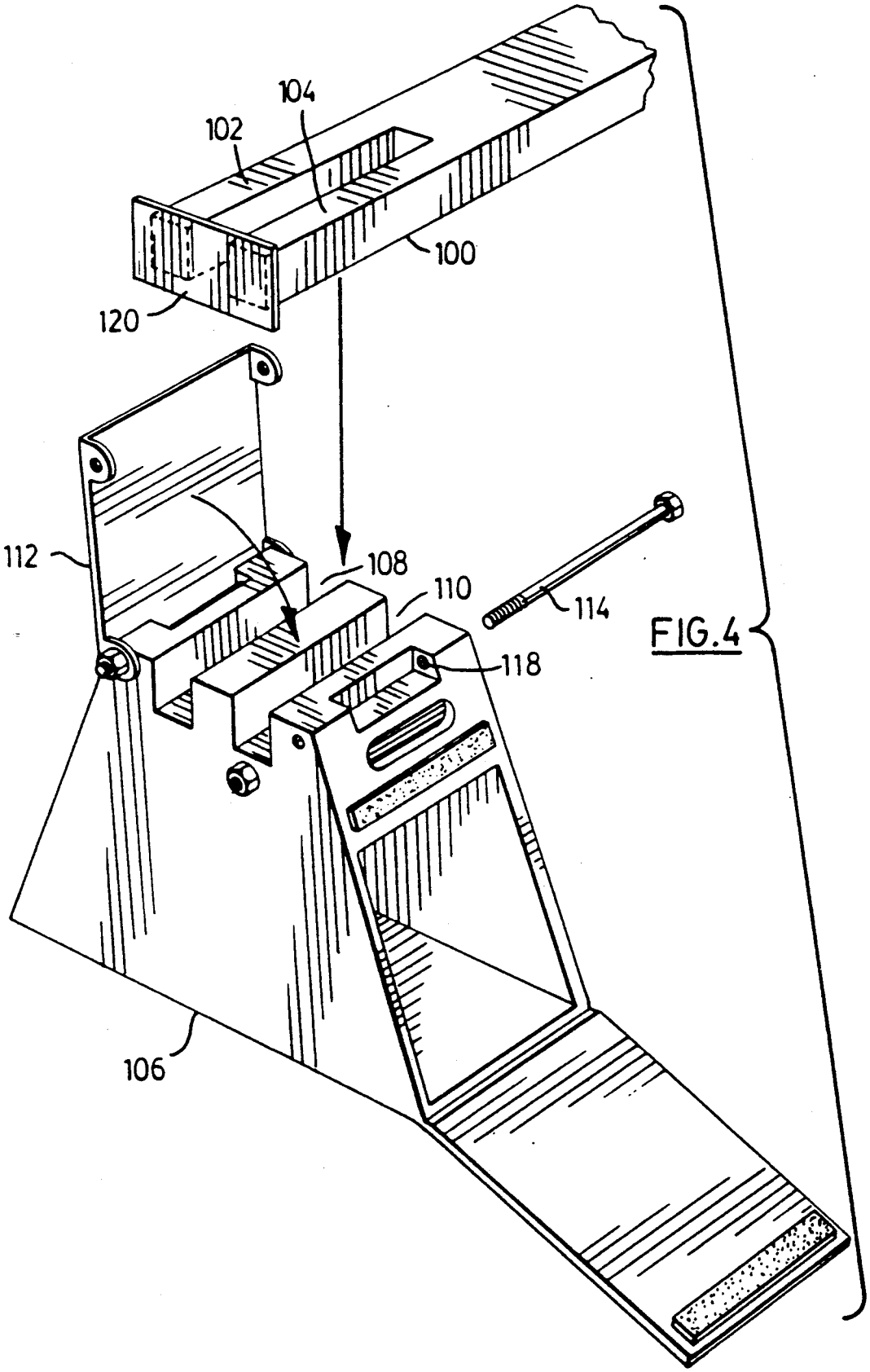
FIG. 4 is a perspective view of exercise apparatus in accordance with a further aspect of the present invention.

FIG. 4 of the drawings illustrates a portion of an exercising apparatus in accordance with a further aspect of the present invention. The mounting portion 100 of a mounting member is shown, the mounting portion 100 formed, as above, as a truncated triangular section. The weight 106 is of generally similar configuration to the weights 22, 24 described above but is provided with a different channel configuration, in the form of an open topped channel 108. Mounting member retaining means in the form of a locking plate 112 is provided on the weight 106. The underside of the plate 112 is provided with a locating portion 106 for fitting over the mounting portion 100, with a complementary engaging surface. The plate 112 may be moved from a retracted position, as illustrated, to a locking position in which the plate 112 extends across the top of the channel 108 to retain the mounting portion 100 therein. To prevent the mounting portion 100 from being withdrawn from the channel 108 the plate is provided with a small protrusion 102 to be received by an indentation in the upper surface of the mounting portion 104.

The plate 112 is pivotally mounted at one side of the weight 106 and may be secured in the locked position by a threaded pin 114 which extends through apertured ears 116 on the plate and throughbores 118 in the upper portion of the weight 106.

Figure 5:
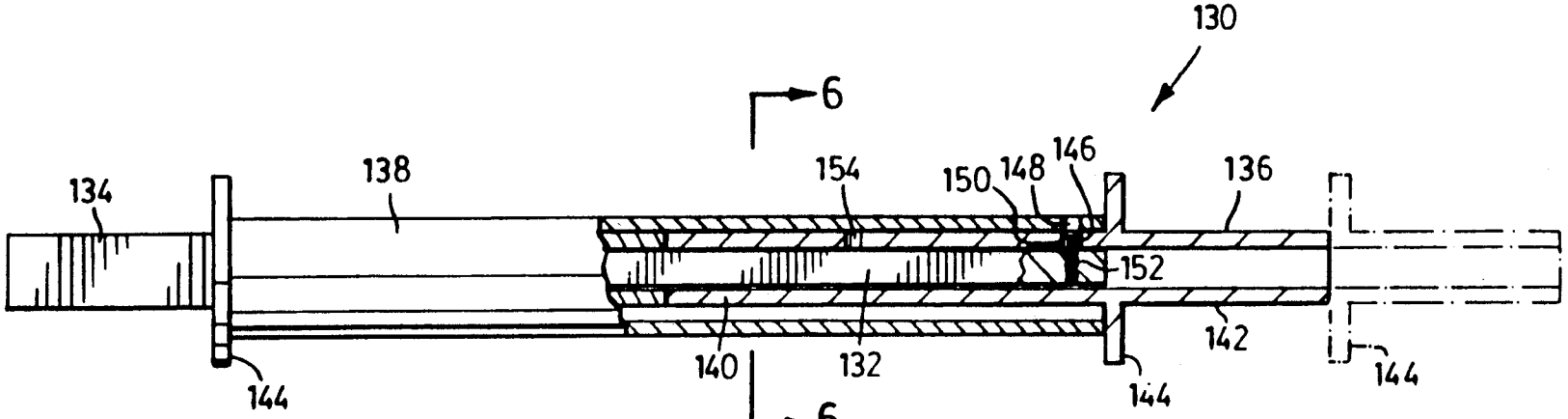
FIG. 5 is a part-sectional view of an adjustable mounting member in accordance with a still further aspect of the present invention.
Figure 6:
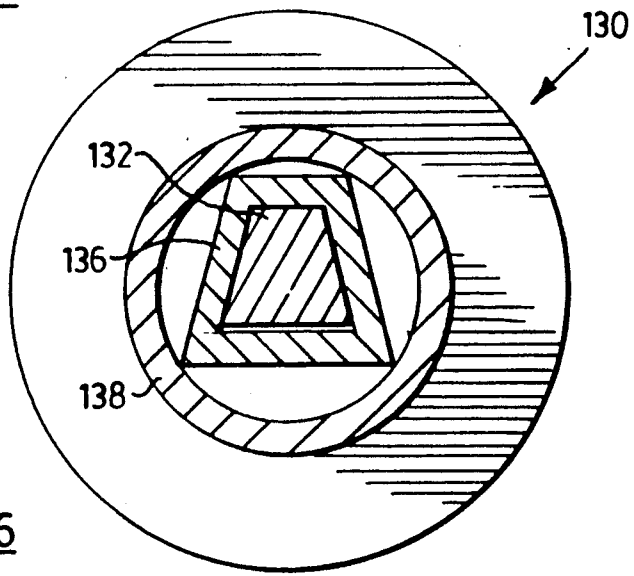
FIG. 6 is a sectional view on line 6—6 of FIG. 5.

FIG. 5 of the drawings illustrates an adjustable mounting member 130 in accordance with a still further aspect of the present invention. The member 130 includes a bar 132, mounting portions 134, 136 and a grip portion 138 in the form of a tubular sleeve. The mounting portions 134, 136 are also tubular and fit over the bar 132, while the grip portion 138 is fitted over the mounting portions 134, 136.

Each mounting portion 134, 136 has a bar receiving part 140 and a weight engaging part 142. A weight locating plate 144 is provided on the exterior of each mounting portion, 134, 136 between the parts 140, 142.

The bar 132 and the mounting portions 134, 136 are of truncated triangular cross section, while the grip portion 138 is cylindrical.

The illustrated mounting member configuration provides a mounting member which may be used in a shorter configuration (as shown in solid outline), or in a longer configuration (as shown to the right hand end of FIG. 5).

The bar receiving parts 140 of the mounting portions 134, 136 are of length equal to half of the length of the bar 132 and the weight engaging part 142 of each mounting portion 134, 136 is approximately half of the length of the respective bar receiving part 140. In the shorter configuration, the mounting portions 134, 136 abut within the grip portion 138 and the bar 132 is located within the bar receiving parts 140. The mounting portions 134, 136 are held in position relative to the bar 132 by screws 146 which are passed through openings 148, 150 in the grip portion 138 and the bar receiving parts 140 and into bores 152 provided in the ends of the bar 132 (only one securing arrangement visible).

To provide the longer configuration, the screws 146 are removed and the mounting portions 134, 136 separated such that a portion of the bar receiving parts 140 extend beyond the end of the bar 132. The mounting portions 134, 136 are again held in position by passing the screws 146 through further openings 154 provided in the bar receiving part 140 of the mounting portion 136 into the bores 152.

The mounting of weights on the mounting member 130 is accomplished in a similar manner to that described with reference to FIG. 1.

In the shorter configuration, a 32 inch bar, provided in conjunction with two 24 inch mounting portions provides a bar of length 48 inches. In the longer configuration, the mounting member 130 has an overall length of 64 inches.

The provision of a bar which can be adjusted two different lengths allows the same bar to be used for a range of exercises or lifts which would normally be carried out using bars of different lengths, and permits use of a single bar by persons of substantially different stature. Also, for transport and storage, the member 130 may be dismantled, in which case the longest component would be either the grip portion 138 or the bar 132, both of which are considerably shorter than the mounting member 130 in the shorter configuration.

The embodiments of the present invention as described above are used in similar fashion and in a manner substantially similar to a conventional barbell. However, the rotating grip portion allows for rotation of the weights and thus is less abrasive on the hands of the lifter. Also, the positioning of the channels for mounting the weights above the center of gravity of the weights results in the weights tending to maintain a similar orientation throughout the normal range of movement of the apparatus during conventional exercises. As the center of gravity of the weights remains below the mounting member, the apparatus will be more stable. Also, the provision of weights with a planar base allows the apparatus to be safely located on planar supporting surfaces, unlike convention barbells provided with disc shaped weights.

Location of weights on the mounting member or bar is also facilitated by the provision of a planar base for the weights, as a weight may be located on a surface and then the bar positioned relative to the weight. In the first described embodiment, the end of the bar is passed through the channel in the weight, whereas in the second described embodiment the bar is lowered into the channels in the upper surface of the weight. In conventional barbells, it is necessary to support both the weights and the bar while positioning the weight on the bar.

Although both embodiments of weights described above are described with reference to use with a mounting member in the form of a bar, the weights may be readily adapted for use with other forms of weight training or lifting apparatus. Also, it is possible to provide unitary weights in which the weighted units are integral with the weight, rather than providing a variety of separable weighted units. It will be clear to those skilled in the art that various other improvements and modifications may be made to the apparatus within the scope of the present invention.

I claim:

1. An exercise weight having a substantially planar base, a top and a plurality of side walls and mounting means located above the center of gravity of the weight, said mounting means comprising non-circular channel means for non-rotatably releasably receiving a mounting member of complementary cross-section said weight having openable door means in at least one of said side walls located below said mounting means, to permit insertion and removal of weight units.

2. The weight of claim 1, wherein the weight portion comprises weight support means fixed to the mounting means and adapted for mounting the weighted unit.

3. The weight of claim 2, wherein the weighted unit is of complementary shape to the interior of the shell.

4. The weight of claim 3, wherein the door means is in the form of an openable flap.

5. The weight of claim 3, wherein a plurality of weighted units of common shape and size and of different weights are provided.

6. The weight of claim 3, wherein the weighted unit comprises an exterior shell containing weight material.

7. The weight of claim 3, wherein the weighted unit comprises a plurality of elements of predetermined mass and the mass of the weighted unit may be varied by adding or removing elements from the weighted unit.

8. The weight unit of claim 7, wherein said elements of predetermined mass are arranged to sit together and are of complementary shape to the interior of the shell.

9. The weight of claim 2, wherein the weight support means is in the form of an outer shell and the outer sheel of the weight protion has a substantially planar base, mutually parallel end walls defining truncated triangles and side walls extending downwardly and outwardly from the mounting portion.

10. The weight of claim 9, wherein one of said side walls forms the door means and is hingedly attached to one of the adjacent ends, walls or base.

11. The apparatus of claim 10, wherein the outer shell is formed of plastic.

12. The weight of claim 10, wherein the weight unit has a substantially planar base, mutually parallel end walls defining truncated triangles and side walls extending downwardly and outwardly from an upper surface of the unit to the base.

13. The apparatus of claim 12, wherein carrying handles in the form of indents are provided in the side walls of the weight portion.

14. The weight of claim 1 or 2, wherein the channel means is in the form of a throughbore extending through an upper portion of the weight.

15. The weight of claim 1 or 2, wherein the channel means is defined by a channel formed in an upper surface of the weight and mounting member retaining means movable between a locking position for locking the mounting member in the channel and a retracted position.

16. Exercising apparatus comprising an exercising weight and a mounting member, the weight having a substantially planar base and mounting means above the center of gravity of the weight, said mounting means comprising channel means for releasably receiving a portion of the mounting member, the mounting member having a mounting portion of complementary, non-circular shape to said channel means, the coupling between the channel means and the mounting member arranged to prevent rotation therebetween, and a grip portion rotatable relative to the mounting portion.

17. The apparatus of claim 16, wherein the weight includes a weight containing portion located below the mounting means and the weight containing portion includes a separable weighted unit and weight support means fixed to the mounting means and adapted for mounting the weighted unit.

18. The apparatus of claim 17, wherein the weight support means is in the form of an outer shell including door means to allow a separable weighted unit to be located in the interior of the shell.

19. The apparatus of claim 18, wherein the door means is in the form of an openable flap.

20. The apparatus of claim 18, wherein a plurality of weighted units of common shape and size and of different weights are provided.

21. The apparatus of claim 20, wherein the weighted unit comprises an exterior shell containing weight material.

22. The apparatus of claim 18, wherein the weighted unit comprises a plurality of elements of predetermined mass and the mass of the weighted unit may be varied by adding or removing elements from the weighted unit.

23. The apparatus of claim 18, wherein the outer shell of the weight portion has a substantially planar base, mutually parallel end walls defining truncated triangles and side walls extending downwardly and outwardly from the mounting portion.

24. The apparatus of claim 23 wherein one of said side walls of the outer shell forms the door means to permit placement of the weight unit in the shell.

25. The apparatus of claim 24, wherein the outer shell is formed of plastic.

26. The apparatus of claim 24, wherein the weight unit has a substantially planar base, mutually parallel end walls defining truncated triangles and side walls extending downwardly and outwardly from an upper surface of the unit to the base.

27. The apparatus of claim 16 or 23, wherein the channel means is in the form of a throughbore extending through an upper portion of the weight.

28. The apparatus of claim 27, wherein the mounting member is elongate and two mounting portions are provided thereon, one at either end of the member, and the grip portion is located between the mounting portions.

29. The apparatus of claim 28, wherein the mounting member includes a bar and the grip portion is in the form of a sleeve rotatably mounted over the bar.

30. The apparatus of claim 29, wherein fixed first retaining means are provided on the bar between the grip portion and the mounting portions, for abutting an inner face of the respective weights, and releasable second retaining means are provided, for locating on the mounting portions for retaining the weights to the mounting portions.

31. The apparatus of claim 30, wherein the retaining means are in the form of plates aligned perpendicularly to the bar.

32. The apparatus of claim 31, wherein retaining pins are provided for fixing pairs of plates to one another.

33. The apparatus of claim 16 or 23, wherein the mounting portions are each formed as two spaced bars.

34. The apparatus of claim 33, wherein the channel means is defined by a channel formed in an upper surface of the weight and mounting member retaining means movable between a locking position for locking the mounting member in the channel and a retracted position.

35. The apparatus of claim 16, wherein the mounting member is elongate and is provided with a mounting portion at each end thereof and the grip portion is located between said ends.

36. The apparatus of claim 35, wherein the mounting member includes an elongate bar and the grip portion is tubular and is located over the bar.

37. The apparatus of claim 36, wherein each mounting portion is tubular and is positioned over the ends of the bar and within the ends of the grip portion and are movable between retracted and extended positions to provide a mounting member of variable length configuration.

* * * * *